US006581210B2

(12) United States Patent
Kaloustian

(10) Patent No.: US 6,581,210 B2
(45) Date of Patent: Jun. 24, 2003

(54) BIB AND DISH COMBINATION

(76) Inventor: John Kaloustian, 830 W. Main St., Northville, MI (US) 48167

( * ) Notice: Subject to any disclaimer, the term of this patent is extended or adjusted under 35 U.S.C. 154(b) by 0 days.

(21) Appl. No.: 09/847,553

(22) Filed: May 2, 2001

(65) Prior Publication Data

US 2002/0004945 A1 Jan. 17, 2002

Related U.S. Application Data

(60) Provisional application No. 60/201,097, filed on Sep. 15, 2000.

(51) Int. Cl.[7] ..... A41B 13/10

(52) U.S. Cl. ..... 2/49.1; 2/49.2; 2/49.3

(58) Field of Search ..... 2/49.1, 49.2, 49.3, 2/51, 48, 46, 49.4, 49.5, 75; 220/737, 574, 574.1, 574.3, 575; 224/270

(56) References Cited

U.S. PATENT DOCUMENTS

| | | | | | |
|---|---|---|---|---|---|
| 83,120 | A | | 10/1868 | Mott | |
| 453,490 | A | * | 6/1891 | Kropp | 2/49.2 |
| 590,991 | A | * | 10/1897 | Lenhart | 2/49.2 |
| 879,124 | A | * | 2/1908 | Thompson | 2/49.2 |
| 996,084 | A | * | 6/1911 | Herring | 2/49.2 |
| 2,105,029 | A | | 1/1938 | Doty | |
| 2,224,746 | A | * | 12/1940 | Richstein | 2/48 |
| 2,457,725 | A | | 12/1948 | Rhowmine | |
| 2,532,932 | A | | 12/1950 | Neiswander | |
| 2,588,990 | A | | 3/1952 | Sanchez | |
| 2,637,852 | A | * | 5/1953 | Globe | 2/51 |
| 2,643,384 | A | | 6/1953 | Thompson | |
| 2,738,511 | A | | 3/1956 | Brady | |
| 4,114,199 | A | | 9/1978 | Malan | |
| 4,860,381 | A | | 8/1989 | Bartley | |
| 5,062,558 | A | * | 11/1991 | Stang | 2/49.2 |
| 5,778,450 | A | | 7/1998 | Hagestad et al. | |
| 5,850,956 | A | * | 12/1998 | Hayward, Jr. | 108/43 |
| 5,915,530 | A | | 6/1999 | Hager | |
| 6,021,521 | A | * | 2/2000 | Baratta | 2/49.1 |
| 6,081,923 | A | * | 7/2000 | Marks | 2/49.2 |
| 6,128,781 | A | * | 10/2000 | Spindler | 2/49.3 |

* cited by examiner

*Primary Examiner*—A. Vanatta
(74) *Attorney, Agent, or Firm*—Artz & Artz, PC

(57) ABSTRACT

A bib and dish combination device has a bib that preferably has an opening that is designed to accommodate a wearer's neck and to prevent food or beverage from touching a wearer's clothes as the wearer is eating or drinking. The lower end of the bib is preferably intended to engage a dish that is temporarily attached to a high chair tray or table, such as through suction cups or the like. The bib can be attached to the dish in a variety of different ways such that any food or drink that contacts the bib will roll off the bib and into the dish in order to prevent the spillage from falling into the wearer's lap. Further, the length of the bib retained within the device can be varied to accommodate any size individual.

33 Claims, 5 Drawing Sheets

40
42
64
61
60
44
54
50
48
59
46
55

40
42
54
50
61
48
46
62
48

58-a
55
46
159
59
58
50
54
57
52
42
62
44
40
64
62
48
56
60
61

BIB AND DISH COMBINATION

CROSS REFERENCE TO RELATED APPLICATIONS

The present invention claims priority from U.S. Provisional Application Ser. No. 60/201,097, filed Sep. 15, 2000 and entitled "Bib and Dish Combination."

TECHNICAL FIELD

The present invention relates generally to bibs and more particularly to a bib and dish combination.

BACKGROUND

The use of a bib to protect a wearer's clothing while a wearer is eating is well known. Bibs are typically made of moisture resistant paper or fabric and are placed around a wearer's neck prior to placing the wearer in a high chair. The bib covers a portion of the wearer's clothing, thereby preventing the portion of clothing covered from being soiled by food or beverage dropping from the wearer's mouth while eating or drinking or otherwise contacting the covered areas.

One problem with currently available bibs is that food or beverage that drops from the wearer's mouth may miss the bib entirely or cascade off the bib and land in the wearer's lap, thereby soiling or staining the wearer's clothing not directly covered by the bib. Similarly, food or beverage that drops can soil or stain a carpeted floor or a piece of furniture. This can result in expense to clean or replace the clothing, carpeting, and/or furniture.

While bibs or smocks having pockets exist, that are intended to catch or trap food or beverage that would otherwise fall into a wearer's lap, these pockets do not easily extend far enough to catch food or beverage. Moreover, these pockets are difficult to remove material from and therefore clean.

It is therefore highly desirable to provide an apparatus for preventing food or beverage from contacting a wearer's clothing as the wearer is eating or drinking. It is also highly desirable to provide an apparatus that allows dropped food to be returned to a primary eating location.

SUMMARY OF THE INVENTION

It is thus an object of the present invention to provide a method and apparatus for protecting a wearer's clothing while eating.

It is another object of the present invention to provide a method and apparatus for conveying dropped food from a wearer's bib to a surface where the food or beverage was initially located.

It is further object of the present invention to prevent the spread of germs associated with food that has contacted the wearer and has fallen on the wearer or floor.

The above and other objects are accomplished by providing a wearer bib and dish combination. The bib preferably has an opening that is designed to accommodate a wearer's neck and to prevent food or beverage from touching a wearer's clothes as the wearer is eating or drinking. The lower end of the bib is preferably intended to engage a dish that is temporarily attached to a high chair tray, such as through suction cups or the like. The bib can be attached to the tray in a variety of different ways such that any food or drink that contacts the bib will roll off the bib and into the dish in order to prevent the spillage from falling into the wearer's lap.

In an alternative arrangement, a separate food-catching compartment can be attached to the bib and dish combination device to catch food that may fall from a wearer's mouth. The compartment prevents the wearer from retrieving the food that has fallen. Similarly, this separate food catching compartment can be incorporated into the bib or dish.

In other preferable alternative arrangement, a device can be added to the bib and dish combination device whereby the combination can be secured to a high chair tray or table.

Other objects and advantages of the present invention will become apparent upon considering the following detailed description and appended claims, and upon reference to the accompanying drawings.

DESCRIPTION OF THE PREFERRED EMBODIMENT(S)

Figures 1, 2, 3:
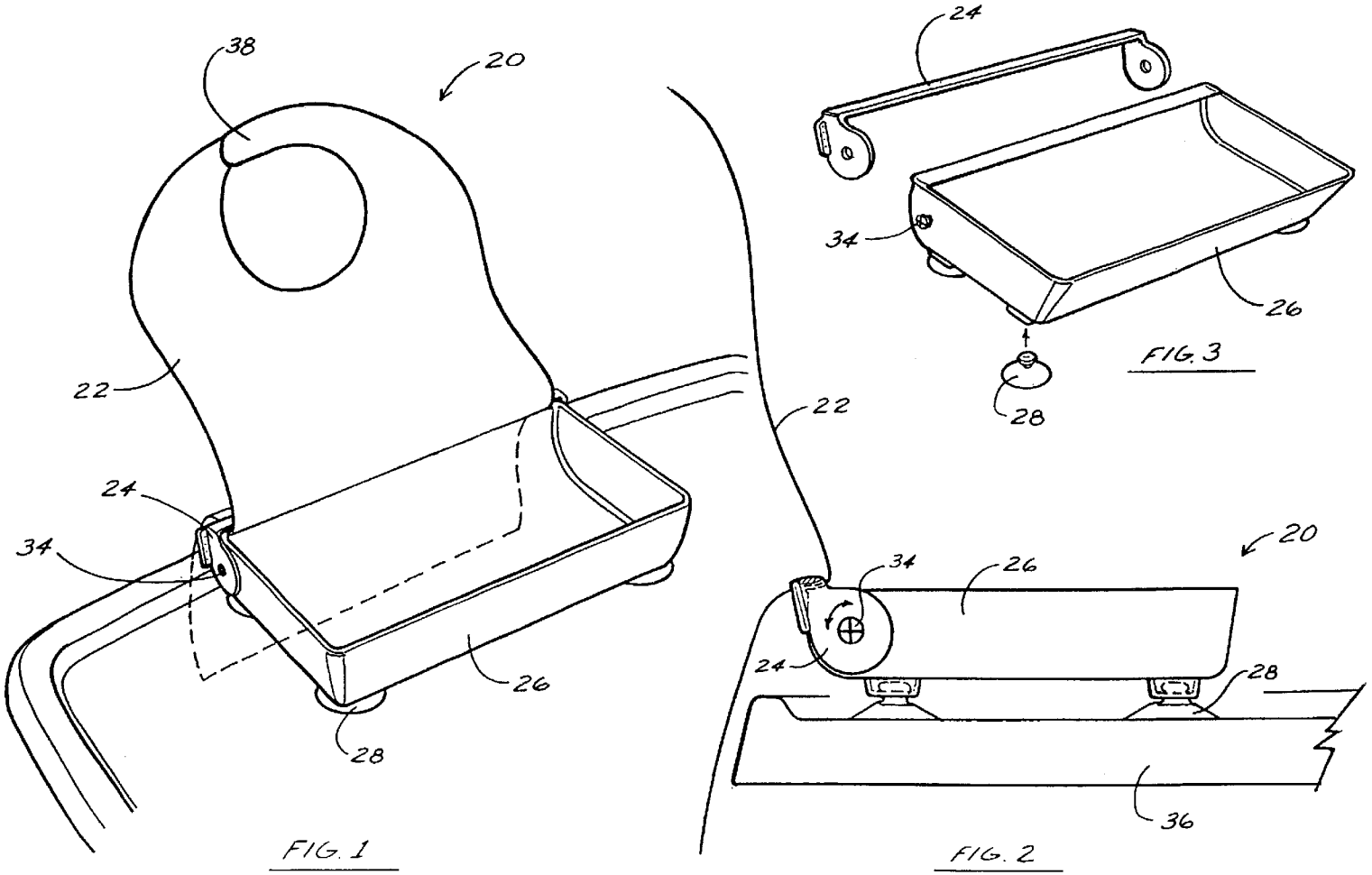
FIG. 1 is a perspective view of a bib and dish combination device according to a preferred embodiment of the present invention.
FIG. 2 is a side view of the bib and dish combination device of FIG. 1.
FIG. 3 is an exploded view of the dish and lock bar portion of the bib and dish combination device of FIG. 1.

Referring now to FIGS. 1–3, a bib and dish combination device 20 according to one preferred embodiment is illustrated. The device 20 has a bib 22, a lock bar 24, a dish 26, and a plurality of suction cups 28 located on the bottom of the dish 26. As shown in FIGS. 1 and 2, the bib 22 is preferably secured to the dish 26 by snapping the lock bar 24 to a pair of snaps 34 located on the dish 26 and pivoting the lock bar 24 to a closed position to pinch the bib 22 and to ensure that the bib is pushed forward over the dish 26. The lock bar 24 is intended to pivot and snap closed to retain the bib 22 at a desired length. As shown, the lock bar 24 can rotate in the direction of the arrows between an unlocked position and a locked position to allow for adjustment of the bib length. The suction cups 28 are preferably secured to a high chair tray 36 or table (not shown). However, other attachment apparatus may be utilized. The bib 22 may have a hook and loop attachment 38 or some other similar type of fastening device known in the art for easy attachment and detachment from the wearer or may be just an opening without an attachment mechanism. Moreover, the bib may be made from moisture resistant paper, fabric or the like. Further, the dish 26 and lock bar 24 may be formed of a rigid material such as plastic or other non-absorbent material.

Figures 4, 5, 6:
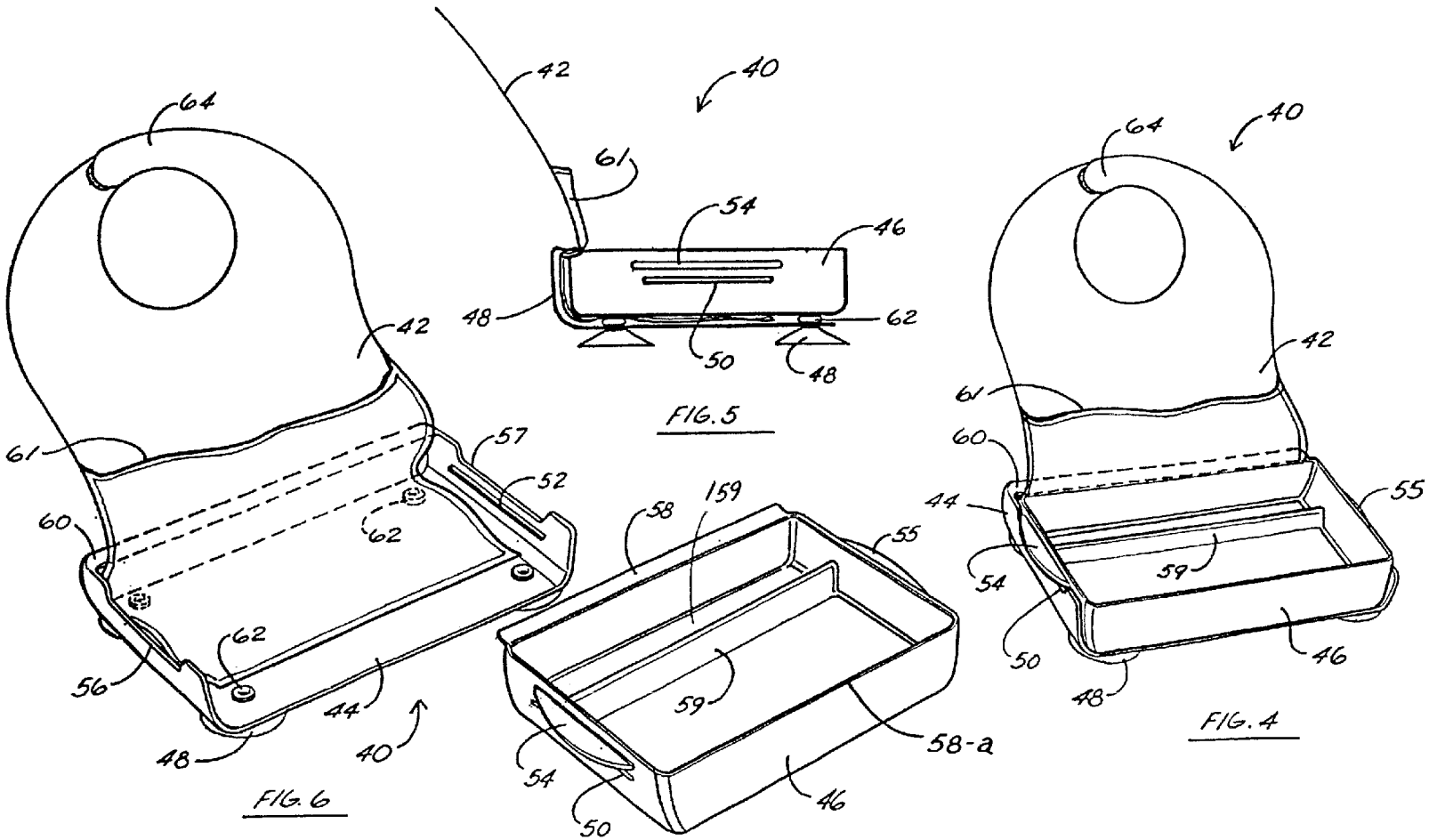
FIG. 4 is a perspective view of a bib and dish combination device according to another preferred embodiment of the present invention.
FIG. 5 is a side view of the bib and dish combination device of FIG. 4.
FIG. 6 is an exploded view of the dish, dish base, and bib of the bib and dish combination device of FIG. 4.

Referring now to FIGS. 4–6, an alternative preferred embodiment of bib and dish combination device 40 is shown having a bib 42, a dish base 44, a dish 46, and a plurality of suction cups 48. The dish base 44 is secured to the dish 46 by snapping a female snap lock 50 on the dish 46 into a male snap lock 52 in the dish base 44 with the bib 42 located therebetween. A pair of flanges 54, 55 on the dish 46 rest on a respective recessed area 56, 57 on the dish base 44. The bib 42 is pinched between a dish lip 58 formed on the dish 46 and a dish base lip 60 formed on the dish base 44. This ensures that the bib 42 is pushed forward over the dish 46 when the dish base 44 is secured to the dish 46. A suction cup lip 62 pinches and locks the bib 42 in place.

In addition, as shown in FIGS. 4 and 6, a partition 59 may be incorporated into the dish 46 to separate it into separate compartments for food. Also, as shown on FIG. 6, a grooved top surface 58*a* may be added to the dish 46. A lid (not shown) having a corresponding flange may then be secured to the grooved top surface 58*a*, thereby allowing the dish 46 to be used as a storage container.

The bib 42 is adjustable to comfortably be positioned on a wearer by simply altering the amount of bib 42 secured between the dish 46 and dish base 44. The bib 42 may have a hook and loop attachment 64 or some other similar type of fastening device known in the art for easy attachment and detachment from the wearer or may be just an opening without an attachment mechanism. Moreover, the bib 42 may be made from moisture resistant paper, fabric or the like. Further, the dish 46 and dish base 44 may be formed of a rigid material such as plastic or other non-absorbent material.

Referring now to FIGS. 7–10, an alternative preferred embodiment of the bib and dish combination device 70 is shown having a bib 72, a dish 74, and a clamp bar 75. The clamp bar 75 has a pair of arms 77 on either side of a central region 76. Each arm 77 has a retention clip 79. The clamp bar 75 is preferably attached to the back 78 of the dish by inserting each of the arms 77 within a retention feature 81 until the retention clip 79 is secured within an opening 83. In an alternative embodiment (not shown), the clamp bar 75 may be formed integral to the back 78 of the dish 74.

Figures 7, 8, 9, 10:
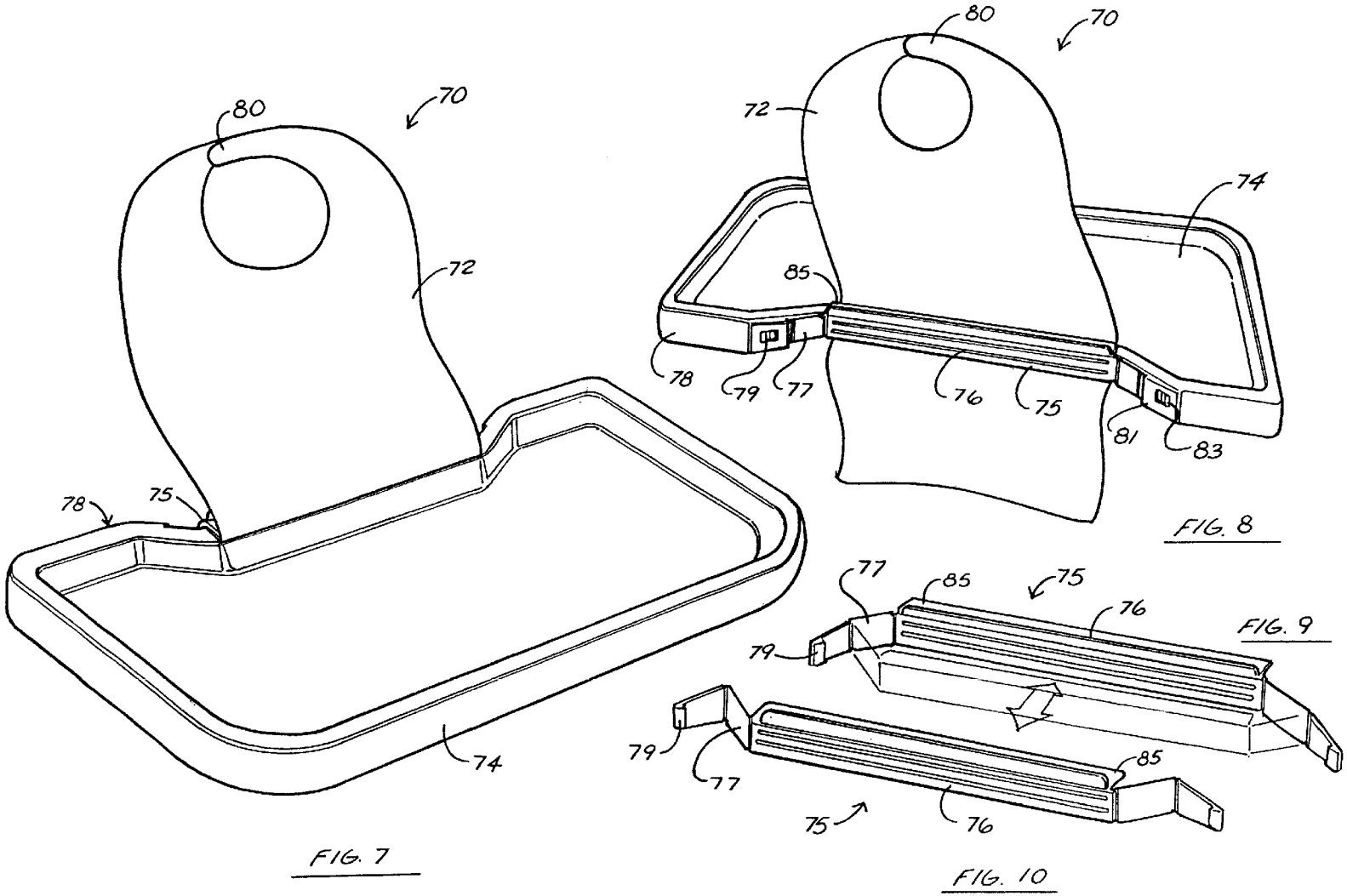
FIG. 7 is a perspective view of a bib and dish combination device according to another preferred embodiment of the present invention.
FIG. 8 is a rear view of the bib and dish combination device of FIG. 7.
FIG. 9 is a perspective view of the clamp bar of FIG. 8 in a closed position.
FIG. 10 is a perspective view of the clamp bar of FIG. 8 in an open position.

The clamp bar 75 is normally biased in a closed position, as shown in FIGS. 8 and 9, adjacent to the back 78 of the dish 74 to pinch the bib 72 against the back. However, the clamp bar 75 can flex back to an open position, as shown in FIG. 10 and in phantom in FIG. 9, to allow the bib 72 to be threaded between the clamp bar 75 and the back 78. A wearer's torso prevent the clamp bar 75 from being moved to an unbiased position.

A lip 85 on the clamp bar 75 ensures that the bib 72 is pushed forward towards the dish 74 in the closed position. The bib 72 is adjustable to be comfortably positioned on a wearer by simply altering the amount of bib 72 clamped at a desired length. The bib 72 may have a hook and loop attachment 80 or some other similar type of fastening device known in the art for easy attachment and detachment from the wearer or may be just an opening without an attachment mechanism. Moreover, the bib 72 may be made from moisture resistant paper, fabric or the like. Further, the dish 74 and clamp bar 75 may be formed of a rigid material such as plastic or other non-absorbent material. Also, the bib and dish combination device 70 may have suction cups (not shown) or other attachment apparatus to secure the device 70 to a high chair or table.

Figure 12:
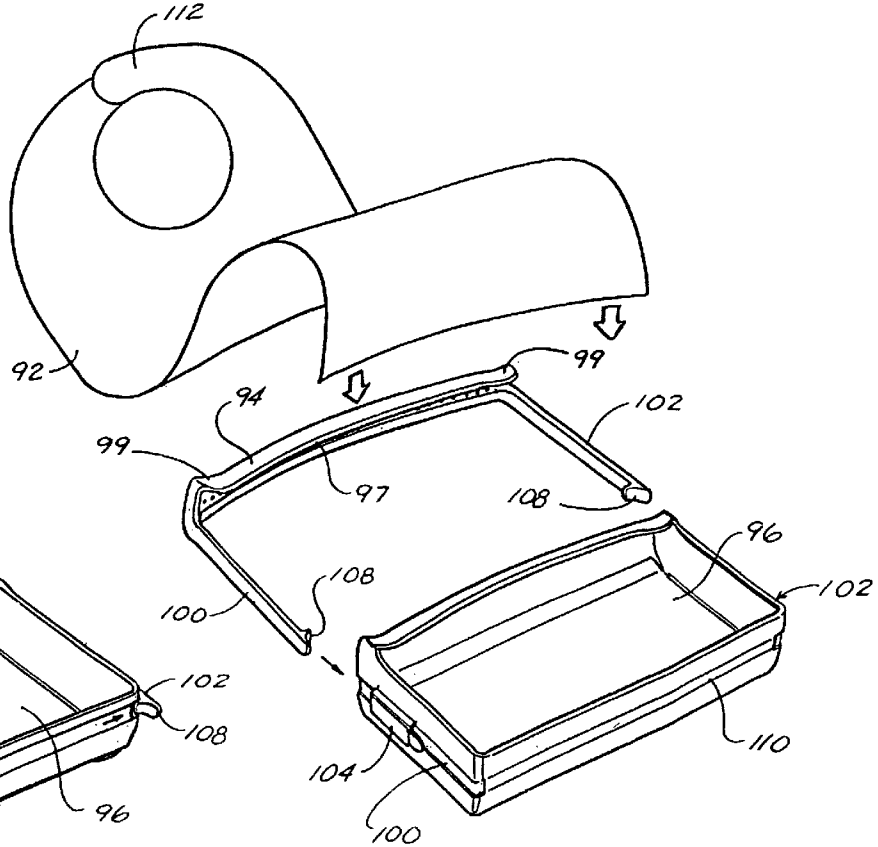
FIG. 12 is an exploded view of the dish, retainer lock bar, and bib portion of the bib and dish combination device of FIG. 11.
Figure 11:
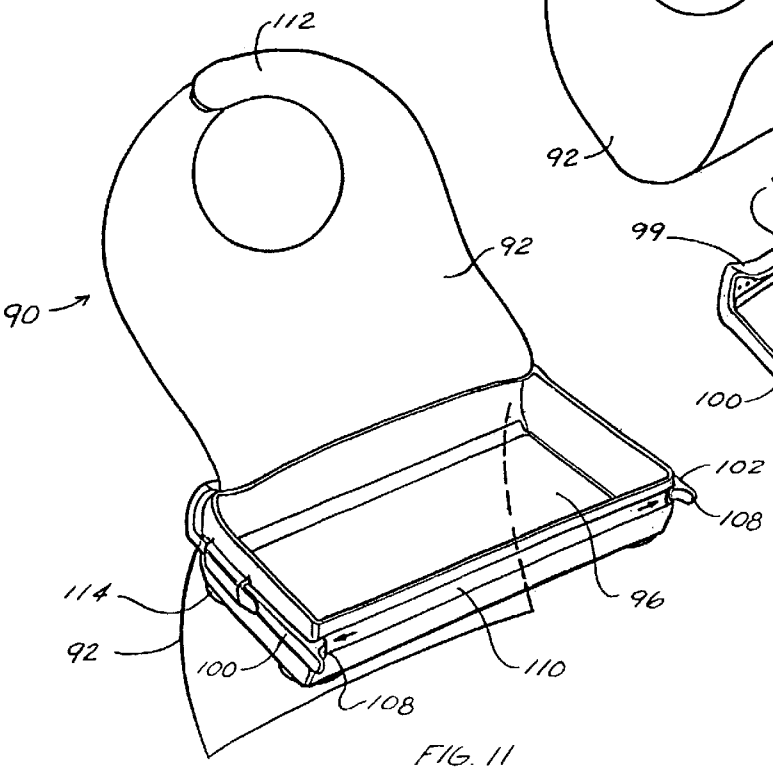
FIG. 11 is a perspective view of a bib and dish combination device according to another preferred embodiment of the present invention.

Referring now to FIGS. 11 and 12, an alternative preferred embodiment of a bib and dish combination device 90 is shown having a bib 92, a retainer lock bar 94 and a dish 96. The bib 92 is placed between the bar 94 and the back 98 of the dish 96. The sides 100, 102 of the retainer lock bar 94 are then slid through a respective retention slot 104 on the sides 100, 102 of the dish 96 until the retainer clips 108 are locked around the front 110 of the dish 96. A lip 97 on the retainer lock bar 94 ensures that the bib is pushed forward towards the dish 96 when the retainer clips 108 are in the locked position. The lip 97 has a pair of funneled flanges 99 located at each end that are sloped downward towards the dish 96 to ensure that food or beverage that falls onto the retainer lock bar 94 deflects inward into the dish 96. To remove the retainer lock bar 94 and bib 92, the retainer clips 108 are unlocked by pushing them away from each other and pulling the lock bar 94 rearward. The bib 92 is adjustable to be comfortably positioned on a wearer by simply altering the amount of bib 92 clamped at a desired length.

The bib 92 may have a hook and loop attachment 112 or some other similar type of fastening device known in the art for easy attachment and detachment from the wearer or may be just an opening without an attachment mechanism. Moreover, the bib 92 may be made from moisture resistant paper, fabric or the like. The dish 96 is retained on a high chair tray or table (not shown) preferably with a plurality of suction cups 114. However, other attachment apparatus may be utilized. Further, the dish 96 and retainer lock bar 94 may be formed of a rigid material such as plastic or other non-absorbent material.

Figures 13, 14, 15:
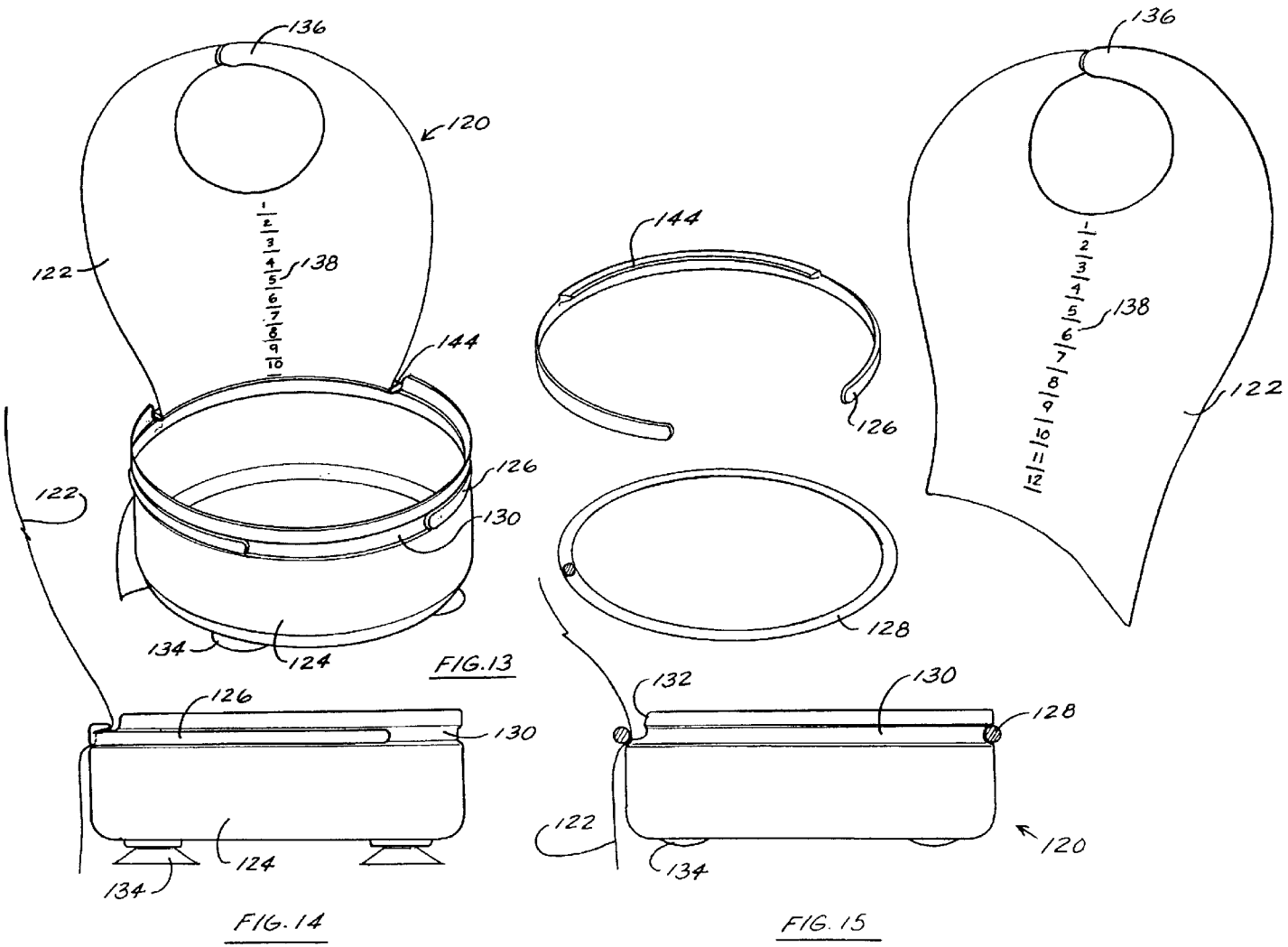
FIG. 13 is a perspective view of a bib and dish combination device according to another preferred embodiment of the present invention.
FIG. 14 is a side view of bib and dish combination device of FIG. 13.
FIG. 15 is an exploded view of the dish, retainer lock bar, o-ring and bib portion of the bib and dish combination device of FIG. 14.

Referring now to FIGS. 13–15, another alternative preferred embodiment of the bib and dish combination device 120 is illustrated having a bib 122, a dish 124, a retainer lock bar 126, and an elastic o-ring 128. The bib 122 is placed between the o-ring 128 and the dish 124. The o-ring 128 is fit into a slot 130, on a cut-back rim 132 on the dish 124. The retainer lock bar 126 is then snapped over the o-ring 128 within the slot 130. A lip 144 on the retainer lock bar 126 and the cut-back rim 132 on the dish ensure that the bib 122 is pushed forward towards the dish 124. The dish 124 is retained on a high chair tray or table (not shown) preferably with a plurality of suction cups 134. However, other attachment apparatus may be utilized. Further, the dish 124 and retainer lock bar 126 may be formed of a rigid material such as plastic or other non-absorbent material.

As best seen in FIG. 15, the bib 122 may have a hook and loop attachment 136 or some other similar type of fastening device known in the art for easily attaching and detaching from the wearer and may be made from moisture resistant paper, fabric or the like. Preferably, the bib 122 also has a series of measurement lines 138 that are used by a user to ensure that the bib is properly and consistently positioned for the wearer's comfort.

The bib and dish combination device of the preferred embodiments described above offer many advantages over a traditional bib and high chair arrangement or bib and table arrangement. First, the bib and dish combination device is portable, thus it can be used at home or away from home. Second, the bib and dish combination is small, being roughly the size of a high chair table, and can be easily stored. Third, the device easily and securely attaches to a wide variety of high chairs and/or tables for convenience. Fourth, the device can be used with commercially available bibs. However, the device is preferably used with a bib having a hook and loop attachment because it is easily removed from the wearer's neck and will self detach if the wearer's neck is moved too far relative to the dish to provide safety to the wearer. Fifth, the device is easily adjustable to the size of the wearer by simply moving the bib relative to the dish portion. Sixth, the device prevents food from falling into the wearer's lap and onto the floor, thereby saving costs associated with cleanup. The lip on the retention device helps to ensure that the bib is pushed forward over the dish. Seventh, and perhaps most important, the device may help prevent the spread of infectious disease by preventing food from falling into a wearer's lap, onto the floor, or on a table in a public place.

In alternative preferred embodiments, a bib having a food-catching pouch 61 (or portion 61) may replace the bibs described above in FIGS. 1–15. The bib is secured to the dish such that the food-catching pouch is located between the dish and the fastening device. This food-catching pouch may catch food or beverage above the dish that has fallen away from the wearer s mouth. This effectively prevents the wearer from attempting to eat any food that has fallen, which may alleviate health concerns related to partially eaten food.

In other alternative embodiments not shown, it is contemplated that the dish in FIGS. 1–3 and 7–15 or the dish base in FIGS. 4–6 could be used as the high chair tray itself, rather than as a separate portable structure that attaches to a high chair tray.

In combination with the preferred embodiments shown in FIGS. 1–15, a separate food catching compartment (shown as 159 in FIG. 6) can be incorporated into the dish to catch food that may fall from a wearer's mouth. The compartment 159 is separate from the food compartment such that the fallen food will not mix with the food to be eaten thereby preventing the wearer from retrieving the food that has fallen. This effectively prevents the wearer from attempting to eat the food that has fallen, which may alleviate health concerns related to partially eaten food. The compartment can be a separate attachable piece to the dish or may be co-molded on the dish itself.

While the invention has been described in terms of preferred embodiments, it will be understood, of course, that the invention is not limited thereto since modifications may be made by those skilled in the art, particularly in light of the foregoing teachings.

What is claimed is:

1. A bib and dish combination device used to aid in preventing food or drink from falling into a wearer's lap, the device comprising:

a bib;

a dish; and a first structure for reversibly retaining said bib against an inner side of said dish at a variety of different lengths between said first structure and said inner side of said dish, said inner side being in closest proximity with the wearer of said bib; said first structure being moveable with respect to said dish to allow adjustment of said bib.

2. The device of claim 1, wherein said first structure comprises a pivoting lock bar coupled to said dish, said pivoting lock bar capable of pushing said bib over said dish.

3. The device of claim 2, wherein said dish has at least one suction cup for reversibly securing a bottom side of said dish to a high chair tray or a table.

4. The device of claim 1, wherein said first structure comprises a dish base having a dish base lip, a first recessed area, a second recessed area, at least one suction cup each having a suction cup lip, and a male snap lock, said at least one suction cup intended to secure said dish base to a high chair or other surface;

wherein said dish has a first flange, a second flange, a female snap lock, a bottom portion, and a dish lip;

said bib being reversibly secured between said dish and said dish base when said female snap lock is inserted into said male snap lock, said first flange is rested on said first recessed area, and said second flange is rested on said second recessed area, thereby pinching a first portion of said bib between said dish lip and said dish base lip and pinching a second portion of said bib between at least one of said at least one suction cup lips and said bottom portion.

5. The device of claim 1, wherein said first structure comprises a flexible clamp bar coupled to said dish, said flexible clamp bar capable of flexing between an open position and a closed position, said open position allowing said bib to be placed between said clamp bar and said dish and said closed position retaining said bib between said clamped bar and said dish, wherein said clamp bar is normally biased in said closed position.

6. The device of claim 5, wherein said flexible clamp bar has an upper lip, said upper lip functioning to push said bib forward over said dish when said flexible clamp bar is in said closed position.

7. The device of claim 1, wherein said first structure comprises a retainer lock bar having a pair of retainer clips and wherein said dish has a pair of retention slots, said bib being reversibly retained between said retaining lock bar and a back of said dish by inserting each of said pair of retainer clips through a respective one of said pair or retention slots such that each of said pair of retaining clips is coupled to a front portion of said dish.

8. The device of claim 7, wherein said dish has at least one suction cup for reversibly securing a bottom side of said dish to a high chair tray or a table.

9. The device of claim 1, wherein said first structure comprises a retainer lock bar and an elastic o-ring and wherein said dish has a slot, said bib being reversibly retained to said dish by fitting said o-ring into said slot containing a first portion of said bib, and snapping said retainer lock bar over said o-ring within said slot.

10. The device of claim 9, wherein said retainer lock bar has a lip that functions to ensure that said bib is pushed forward towards said dish.

11. The device of claim 9, wherein said dish has at least one suction cup for reversibly securing a bottom side of said dish to a high chair tray or a table.

12. The device of claim 1, wherein said bib has a food-catching portion, said food catching portion capable of catching food falling from a wearer's mouth and preventing the wearer from retrieving the food when said bib is reversibly retained to said dish.

13. The device of claim 1 further comprising a food-catching compartment coupled to said dish, said food-catching compartment capable of catching food falling from a wearer's mouth and prevent the wearer from retrieving the food.

14. The device of claim 13, wherein said food-catching compartment is co-molded with said dish.

15. A method for preventing food and beverage from contacting a wearer's lap as the wearer is eating or drinking, the method comprising the steps of:

reversibly coupling an upper portion of a flexible bib to a wearer;

reversibly retaining a lower portion of said flexible bib to a dish such that said flexible bib can be adjusted to a variety of lengths to accommodate wearers of different sizes; and reversibly retaining said dish to a high chair tray or a table.

16. The method of claim 15, wherein the step of reversibly retaining a lower portion of said flexible bib to a dish comprises the steps of:

placing a pivoting lock bar on said dish in an open position;

inserting a lower portion of said bib between said pivoting lock bar and said dish; and pivoting said pivoting lock bar to a closed position to reversibly retain said lower portion of said bib against said dish.

17. The method of claim 15, wherein the steps of reversibly retaining a lower portion of said flexible bib to a dish and reversibly retaining said dish to a high chair tray or a table comprises the steps of:

placing a lower portion of said bib on top of a portion of a dish base, said dish base having a snap lock, a base lip, a first recessed area, a second recessed area, and a suction cup having a suction cup lip;

reversibly coupling a dish having a first flange, a second flange, a bottom portion, a female snap lock and a dish lip to said dish base by inserting a male snap lock in said female snap lock and placing said first flange upon said first recessed area and said second flange upon said second recessed area, wherein said lower portion of said bib is reversibly retained between said base lip and said dish lip and is also reversibly retained between said suction cup lip and said bottom portion; and reversibly retaining said dish base to a high chair tray or a table.

18. The method of claim 15, wherein the step of reversibly retaining a lower portion of said flexible bib to a dish comprises the steps of:

coupling a clamp bar to an inner portion of a dish;

moving a clamp bar from a closed position to an open position;

inserting said lower portion of said bib between said clamp bar and said inner portion; and moving said clamp bar from said open position to said closed position, wherein said lower portion of said bib is reversibly retained between said clamp bar and said inner portion of said dish.

19. The method of claim 15, wherein the step of reversibly retaining a lower portion of said flexible bib to a dish comprises the steps of:

inserting a lower portion of said bib between a retainer lock bar and a back portion of said dish; and inserting each side of said retainer lock bar into a respective retention slot such that a retaining clip located on each end of said retaining clip is coupled to a front side of said dish, wherein said lower portion of said bib is reversibly retained between said retainer lock bar and said back portion of said dish.

20. The method of claim 15, wherein the step of reversibly retaining a lower portion of said flexible bib to a dish comprises the steps of:

coupling a lower portion of said bib to said between an o-ring and a rim of said dish;

snapping a retainer lock bar over said o-ring within said rim, wherein said lower portion of said bib is reversibly retained between said o-ring and said rim.

21. A portable bib and dish combination device used to aid in preventing food or drink from falling into a wearer's lap for coupling to a high chair or other surface, the device comprising:

a bib;

a dish;

a first structure for reversibly retaining said bib against an inner side of said dish at a variety of different lengths between said first structure and said inner side of said dish, said inner side being in closest proximity with the wearer of said bib, said first structure being moveable with respect to said dish to allow adjustment of said bib; and a second structure for reversibly retaining the bib and dish combination device to the high chair or other surface.

22. The device of claim 21, wherein said second structure comprises at least one suction cup.

23. The device of claim 22, wherein said suction cup is secured to a bottom portion of said dish.

24. The device of claim 21, wherein said first structure comprises a pivoting lock bar coupled to said dish.

25. The device of claim 22, wherein said first structure comprises a dish base having a dish base lip, a first recessed area, a second recessed area, a male snap lock, and said at least one suction cup each having a suction cup lip, wherein said at least one suction cup is intended to secure said dish base to the high chair or other surface;

wherein said dish has a first flange, a second flange, a female snap lock, a bottom portion, and a dish lip;

said bib being reversibly secured between said dish and said dish base when said female snap lock is inserted into said male snap lock, said first flange is rested on said first recessed area, and said second flange is rested on said second recessed area, thereby pinching a first portion of said bib between said dish lip and said dish base lip and pinching a second portion of said bib between at least one of said at least one suction cup lips and said bottom portion.

26. The device of claim 21, wherein said first structure comprises a flexible clamp bar coupled to said dish, said flexible clamp bar capable of flexing between an open position and a closed position, said open position allowing said bib to be placed between said clamp bar and said dish and said closed position retaining said bib between said clamped bar and said dish, wherein said clamp bar is normally biased in said closed position.

27. The device of claim 26, wherein said flexible clamp bar has an upper lip, said upper lip functioning to push said bib forward over said dish when said flexible clamp bar is in said closed position.

28. The device of claim 21, wherein said first structure comprises a retainer lock bar having a pair of retainer clips and wherein said dish has a pair of retention slots, said bib being reversibly retained between said retaining lock bar and a back of said dish by inserting each of said pair of retainer clips through a respective one of said pair or retention slots such that each of said pair of retaining clips is coupled to a front portion of said dish.

29. The device of claim 21, wherein said first structure comprises a retainer lock bar and an elastic o-ring and wherein said dish has a slot, said bib being reversibly retained to said dish by fitting said o-ring into said slot containing a first portion of said bib, and snapping said retainer lock bar over said o-ring within said slot.

30. The device of claim 29, wherein said retainer lock bar has a lip that functions to ensure that said bib is pushed forward towards said dish.

31. The device of claim 21, wherein said bib has a food-catching portion, said food catching portion capable of catching food falling from a wearer's mouth and preventing the wearer from retrieving the food when said bib is reversibly retained to said dish.

32. The device of claim 21 further comprising a food-catching compartment coupled to said dish, said food-catching compartment capable of catching food falling from a wearer's mouth and prevent the wearer from retrieving the food.

33. The device of claim 32, wherein said food-catching compartment is co-molded with said dish.

* * * * *

UNITED STATES PATENT AND TRADEMARK OFFICE

CERTIFICATE OF CORRECTION

PATENT NO. : 6,581,210 B2
DATED : June 24, 2003
INVENTOR(S) : John Kaloustian

It is certified that error appears in the above-identified patent and that said Letters Patent is hereby corrected as shown below:

Column 6,
Line 40, should read as follows:
-- clips through a respective one of said pair of retention slots --

Signed and Sealed this

Second Day of March, 2004

JON W. DUDAS
*Acting Director of the United States Patent and Trademark Office*